US012767481B2

(12) United States Patent
Kato et al.

(10) Patent No.: US 12,767,481 B2
(45) Date of Patent: Oct. 20, 2026

(54) FIBER BUNDLE DRAWING APPARATUS, METHOD OF DRAWING FIBER BUNDLE, AND METHOD OF MANUFACTURING FIBER COMPOSITE MATERIAL

(71) Applicant: Toray Industries, Inc., Tokyo (JP)

(72) Inventors: Tomohiko Kato, Nagoya (JP); Tamotsu Suzuki, Otsu (JP); Ryota Nakao, Otsu (JP)

(73) Assignee: Toray Industries, Inc., Tokyo (JP)

( * ) Notice: Subject to any disclaimer, the term of this patent is extended or adjusted under 35 U.S.C. 154(b) by 253 days.

(21) Appl. No.: 18/716,968

(22) PCT Filed: Dec. 9, 2022

(86) PCT No.: PCT/JP2022/045439
§ 371 (c)(1),
(2) Date: Dec. 4, 2024

(87) PCT Pub. No.: WO2023/106396
PCT Pub. Date: Jun. 15, 2023

(65) Prior Publication Data

US 2025/0100843 A1 Mar. 27, 2025

(30) Foreign Application Priority Data

Dec. 10, 2021 (JP) ..... 2021-200714

(51) Int. Cl.
*B65H 57/18* (2006.01)
*B65H 57/02* (2006.01)
(Continued)

(52) U.S. Cl.
CPC ..... *B65H 57/18* (2013.01); *B65H 57/02* (2013.01); *B65H 57/04* (2013.01); *B65H 57/14* (2013.01); *B65H 2701/314* (2013.01)

(58) Field of Classification Search
CPC ..... B65H 57/02; B65H 57/04; B65H 57/14; B65H 57/18
(Continued)

(56) References Cited

U.S. PATENT DOCUMENTS 4,645,135 A * 2/1987 Morris ..... B65H 54/28 242/471
5,487,512 A * 1/1996 Nojiri ..... B65D 85/675 242/548.1
(Continued)

FOREIGN PATENT DOCUMENTS

EP 2757063 A1 * 7/2014 ..... B65H 57/18
JP H04317962 A 11/1992
(Continued)

OTHER PUBLICATIONS

Translation JP 2845636.*
(Continued)

*Primary Examiner* — Shaun R Hurley
(74) *Attorney, Agent, or Firm* — DLA Piper LLP (US)

(57) ABSTRACT

A fiber bundle drawing apparatus includes: a bobbin holder to hold the bobbin in a rotatable state; a bending-twisting mechanism to receive the fiber bundle drawn from the bobbin, and to turn and deliver the fiber bundle, thereby reducing change in course of the fiber bundle in a direction parallel to a center axis of the bobbin; and a twist prevention mechanism provided between the bobbin holder and the bending-twisting mechanism in a path of the fiber bundle in the apparatus, and including a support portion and a rotation suppression portion, the support portion coming into contact with the fiber bundle, the rotation suppression portion being disposed to face the support portion with a gap through which the fiber bundle passes, the gap having a distance
(Continued)

greater than or equal to a thickness of the fiber bundle and less than or equal to a width of the fiber bundle.

7 Claims, 8 Drawing Sheets

(51) Int. Cl.
*B65H 57/04* (2006.01)
*B65H 57/14* (2006.01)

(58) Field of Classification Search
USPC ..... 57/352, 353
See application file for complete search history.

(56) References Cited

U.S. PATENT DOCUMENTS

| | | | | |
|---|---|---|---|---|
| 5,499,776 | A * | 3/1996 | Nojiri | B65H 55/04 242/178 |
| 5,636,411 | A * | 6/1997 | Greis | D01H 9/008 57/353 |
| 10,239,726 | B2 * | 3/2019 | Bravin | B65H 59/005 |
| 2020/0262673 | A1 * | 8/2020 | Morris | B65H 49/08 |

FOREIGN PATENT DOCUMENTS

| | | | |
|---|---|---|---|
| JP | H0558552 | A | 3/1993 |
| JP | 2845636 | B2 * | 1/1999 |
| JP | 3698227 | B2 | 9/2005 |
| JP | 2007-112607 | | 5/2007 |
| JP | 2008-156104 | | 7/2008 |
| JP | 2012-184279 | | 9/2012 |
| JP | 2013-63822 | | 4/2013 |
| JP | 2014-69949 | | 4/2014 |
| JP | 2016-179680 | | 10/2016 |
| JP | 2019-199321 | | 11/2019 |

OTHER PUBLICATIONS

International Search Report dated Feb. 14, 2023, of counterpart International Application No. PCT/JP2022/045439, along with an English translation.

* cited by examiner

A-A

FIBER BUNDLE DRAWING APPARATUS, METHOD OF DRAWING FIBER BUNDLE, AND METHOD OF MANUFACTURING FIBER COMPOSITE MATERIAL

CROSS REFERENCE TO RELATED APPLICATIONS

This application is a US national stage filing under 35 U.S.C. § 371 of International Application No. PCT/JP2022/045439 filed Dec. 9, 2022, which claims priority to Japanese Patent Application No. 2021-200714 filed Dec. 10, 2021, each of which is incorporated herein by reference in its entirety.

TECHNICAL FIELD

This disclosure relates to a fiber bundle drawing apparatus that draws a fiber bundle traverse-wound around a bobbin at high speed without causing twist.

BACKGROUND

In recent years, as an application of a carbon fiber composite material, a reinforcing material for a high-pressure hydrogen tank used for a hydrogen automobile has attracted attention. To manufacture the high-pressure hydrogen tank, a method of winding and shaping an intermediate material that is generally called "towpreg", around an outer periphery of a liner is adopted. The towpreg is a carbon fiber bundle that has a flat, namely, a laterally-elongated substantially-rectangular cross-section and is impregnated with a thermosetting resin. The high-pressure hydrogen tank is required to have uniform pressure resistance. To realize the uniform pressure resistance in the high-pressure hydrogen tank, it is necessary to wind the towpreg around the liner with a designed width and a designed thickness. Therefore, the towpreg is required to have a stable rectangular cross-sectional shape without defects such as folding and twist of the carbon fiber bundle.

In a step of manufacturing the towpreg, the fiber bundle is drawn at high speed from a bobbin around which the carbon fiber bundle is traverse-wound, the fiber bundle is impregnated with the thermosetting resin, and the resultant fiber bundle is then wound around another bobbin. Therefore, to manufacture the towpreg having the stable rectangular cross-sectional shape, the fiber bundle having the flat rectangular cross-sectional shape in a state of being wound around the bobbin is desirably drawn while maintaining the cross-sectional shape, is desirably caused to travel along a fixed course without meandering, and is desirably impregnated with the resin.

When the fiber bundle is drawn from the bobbin around which the fiber bundle is traverse-wound, and when the fiber bundle is drawn along an axis direction of the bobbin while the bobbin is fixed, the following issues occur. The fiber bundle is twisted corresponding to the number of windings of the fiber bundle wound around the bobbin, and the cross-sectional shape of the fiber bundle does not become the flat rectangular shape. To draw the fiber bundle from the bobbin around which the fiber bundle is traverse-wound, without causing twist, it is necessary to draw the fiber bundle in the following manner. The bobbin is held in a state where the bobbin is rotatable around a center axis of the bobbin, and the fiber bundle is drawn in a direction orthogonal to the center axis of the bobbin in the state. However, even when the fiber bundle is drawn from the bobbin in such a manner, the fiber bundle meanders following a course when the fiber bundle is traverse-wound around the bobbin. In other words, a traveling position of the fiber bundle is changed in the center axis direction of the bobbin with the lapse of time. As a result, it is not possible to cause the fiber bundle to travel along the fixed course.

Thus, as means for removing so-called "traversing" that is change in course of the fiber bundle along the axis direction of the bobbin, a technique disclosed in Patent Literature 1 is made. In the technique disclosed in Japanese Patent Application Laid-Open No. 2012-184279, a bending-twisting roll including a center axis that has a direction of 90 degrees relative to the center axis of the bobbin is provided at a position separated by a certain distance from the bobbin. The traversing of the fiber bundle is replaced with change in incident angle of the fiber bundle to the bending-twisting roll in a plane perpendicular to an axis of the bending-twisting roll. The course of the fiber bundle delivered from the bending-twisting roll is substantially fixed relative to the bending-twisting roll. In other words, the fiber bundle drawn from the bobbin while being traversed is fixed in traveling position by passing through the bending-twisting roll.

On the other hand, an entire outer diameter of the fiber bundle wound around the bobbin is reduced with the lapse of time because the fiber bundle is drawn from the bobbin. Therefore, the traveling position of the fiber bundle comes close to the center axis of the bobbin with the lapse of time. In other words, the traveling position of the fiber bundle received by the bending-twisting roll is changed along the direction of the center axis of the bending-twisting roll with the lapse of time. Therefore, in a technique disclosed in Japanese Patent Application Laid-Open No. 2019-199321, a touch roll coming into contact with the fiber bundle drawn from a surface of the bobbin is provided. A position where the fiber bundle is separated from the touch roll is fixed in the direction perpendicular to the center axis of the bobbin, namely, in the direction of the center axis of the bending-twisting roll. As a result, irrespective of the entire outer diameter of the fiber bundle wound around the bobbin, the traveling position of the fiber bundle received by the bending-twisting roll is maintained at a fixed position in the axis direction of the bending-twisting roll.

The inventors of the present application found that the following issues are present even in the technique disclosed in Japanese Patent Application Laid-Open No. 2019-199321. The position where the fiber bundle is separated from the bobbin reciprocates in the axis direction of the bobbin as long as the fiber bundle is traverse-wound around the bobbin. Therefore, a distance of the course of the fiber bundle from the bobbin to the bending-twisting roll is periodically changed. Therefore, tension of the fiber bundle is periodically changed between the bobbin and the bending-twisting roll. As a result, when the fiber bundle is loosened, the fiber bundle is reversely rotated, and twist occurs in some instances. Occurrence of twist caused by loosening of the fiber bundle easily occurs particularly at a folding-back point of the fiber bundle at an end part of the bobbin.

In a technique disclosed in Japanese Patent Application Laid-Open No. 2008-156104, a guide roll having a side surface curved outward in a convex shape is provided between the bobbin and the bending-twisting roll. When a passage position of the fiber bundle on the side surface of the guide roll is changed, the distance of the course of the fiber bundle from the bobbin to the bending-twisting roll is changed. Therefore, when the fiber bundle drawn from the bobbin passes through the guide roll, periodic change in distance of the course of the fiber bundle from the bobbin to the bending-twisting roll is moderated, and occurrence of twist caused by slack of the fiber bundle is suppressed.

By the technique disclosed in Japanese Patent Application Laid-Open No. 2008-156104, however, it is not possible to suppress drastic tension change occurring when the direction of the fiber bundle is changed at the end part of the bobbin. Therefore, twist may occur on the fiber bundle.

It is desirable to provide a fiber bundle drawing apparatus that can draw a fiber bundle traverse-wound around a bobbin and having a laterally-elongated cross-sectional shape, in particular, a reinforced fiber bundle used for manufacturing a fiber composite material while maintaining the cross-sectional shape, and cause the fiber bundle to travel along the fixed course.

SUMMARY

We thus provide:

(1) According to an aspect of the present disclosure, a fiber bundle drawing apparatus drawing a fiber bundle from a bobbin around which the fiber bundle is traverse-wound is provided. The fiber bundle drawing apparatus includes: a bobbin holder configured to hold the bobbin in a rotatable state; a bending-twisting mechanism configured to receive the fiber bundle drawn from the bobbin, and to turn and deliver the fiber bundle, thereby reducing change in course of the fiber bundle in a direction parallel to a center axis of the bobbin; and a twist prevention mechanism provided between the bobbin holder and the bending-twisting mechanism in a path of the fiber bundle in the apparatus, and including a support portion and a rotation suppression portion, the support portion coming into contact with the fiber bundle, the rotation suppression portion being disposed to face the support portion with a gap through which the fiber bundle passes, the gap having a distance greater than or equal to a thickness of the fiber bundle and less than or equal to a width of the fiber bundle.

In such an aspect, the bending-twisting mechanism may reduce change in course of the fiber bundle. Further, on an upstream of the bending-twisting mechanism, the support portion may maintain the fixed path of the fiber bundle in a direction in which the support portion and the rotation suppression portion face each other. Further, the rotation suppression portion may prevent the fiber bundle from being twisted. As a result, it is possible to draw the fiber bundle that is traverse-wound around the bobbin and has the laterally-elongated cross-sectional shape while maintaining the cross-sectional shape, and to cause the fiber bundle to travel along the fixed course.

(2) In the fiber bundle drawing apparatus according to the above-described aspect, the twist prevention mechanism may be configured to adjust the distance.

Such an aspect makes it possible to draw the fiber bundle having various cross-sectional shapes while maintaining the cross-sectional shape, and to cause the fiber bundle to travel along the fixed course.

(3) In the fiber bundle drawing apparatus according to the above-described aspect, the support portion may be a roll configured to be rotatable around an axis parallel to a direction of a rotation axis of the bobbin.

Such an aspect makes it possible to reduce a possibility that the fiber bundle is damaged by contact with the roll.

(4) In the fiber bundle drawing apparatus according to the above-described aspect, the rotation suppression portion may include a bar disposed in a posture in which a longitudinal direction of the bar is parallel to a direction of a rotation axis of the bobbin.

Such an aspect makes it possible to simplify the configuration of the rotation suppression portion having a low possibility of coming into contact with the fiber bundle, as compared with the support portion.

(5) In the fiber bundle drawing apparatus according to the above-described aspect, the twist prevention mechanism may be configured to move in a direction parallel to a direction of a rotation axis of the bobbin by following change in course of the fiber bundle drawn from the bobbin.

In such an aspect, a distance where the twist prevention mechanism is movable is sufficiently largely provided, which makes it possible to achieve the following effects without preparing the plurality of twist prevention mechanisms corresponding to various widths of the bobbin. In other words, it is possible to attach the bobbin having various widths to the fiber bundle drawing apparatus, and to draw the fiber bundle traverse-wound around the bobbin while maintaining the cross-sectional shape and to cause the fiber bundle to travel along the fixed course.

(6) According to another aspect of the present disclosure, there is provided a method of drawing a fiber bundle from a bobbin around which the fiber bundle is traverse-wound. The method includes continuously drawing the fiber bundle from the bobbin by using the apparatus according to the above-described aspect.

Such an aspect makes it possible to draw the fiber bundle traverse-wound around the bobbin and having the laterally-elongated cross-sectional shape while maintaining the cross-sectional shape, and to cause the fiber bundle to travel along the fixed course.

(7) In the method according to the above-described aspect, the distance may be set to less than or equal to 50% of a width of the fiber bundle.

Such an aspect makes it possible to effectively prevent, by the rotation suppression portion, the fiber bundle from being twisted.

(8) According to still another aspect of the present disclosure, there is provided a method of manufacturing a fiber composite material containing a fiber bundle and a resin impregnated into the fiber bundle. The method includes drawing the fiber bundle from a bobbin around which the fiber bundle is traverse-wound, by using the fiber bundle drawing apparatus according to the above-escribed aspect or the method of drawing the fiber bundle according to the above-described aspect.

Such an aspect makes it possible to manufacture the fiber composite material having a cross-sectional shape with a designed width and a designed thickness.

To cope with the above-described issues, the present disclosure includes the following configurations.

(1) A fiber bundle drawing apparatus drawing a fiber bundle from a bobbin around which the fiber bundle is traverse-wound and causing the fiber bundle to linearly travel, the fiber bundle drawing apparatus including: a bobbin holder configured to hold the bobbin in a rotatable state; a bending-twisting mechanism configured to remove a traverse component, in an axis direction of the bobbin holder, from the fiber bundle drawn from the bobbin; and a twist prevention mechanism provided between the bobbin holder and the bending-twisting mechanism, and including a support portion and a rotation suppression portion, the support portion coming into contact with the fiber bundle drawn from the bobbin, to support the fiber bundle, the rotation suppression portion being adjustably disposed at a position facing the support portion through the fiber bundle drawn from the bobbin, to be separated from the support portion by a distance greater than or equal to a thickness of the fiber bundle and less than or equal to a width of the fiber bundle.

(2) The fiber bundle drawing apparatus according to (1), in which the support portion is a rotatable roll having an axis parallel to an axis direction of the bobbin holder.

(3) The fiber bundle drawing apparatus according to (1) or (2), in which the rotation suppression portion is a bar fixed to cause a longitudinal direction to be parallel to an axis direction of the bobbin holder.

(4) The fiber bundle drawing apparatus according to any one of (1) to (3), in which the twist prevention mechanism reciprocates in a direction parallel to an axis direction of the bobbin holder by following traversing of the fiber bundle drawn from the bobbin.

(5) A method of continuously drawing a fiber bundle in a state where a separation distance between the support portion and the rotation suppression portion is greater than or equal to a thickness of the fiber bundle and is less than or equal to a width of the fiber bundle, by using the fiber bundle drawing apparatus according to any one of (1) to (4).

(6) The method of drawing the fiber bundle according to (5), in which the separation distance between the support portion and the rotation suppression portion is set to less than or equal to 50% of the width of the fiber bundle.

(7) A method of manufacturing a fiber composite material, comprising drawing a fiber bundle from a bobbin around which the fiber bundle is traverse-wound, by using the fiber bundle drawing apparatus according to any one of (1) to (4) or the method of drawing the fiber bundle according to (5) or (6).

REFERENCE SIGNS LIST

Figure 1:
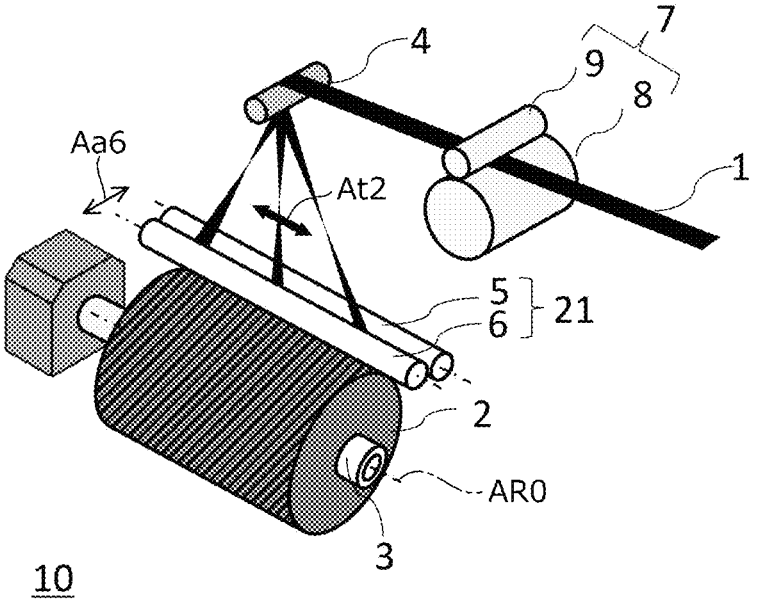
FIG. 1 is a schematic view illustrating one example of a fiber bundle drawing apparatus according to a present example.

1 Fiber bundle
2 Bobbin
3 Bobbin holder
4 Bending-twisting roll (bending-twisting mechanism)
5 Free roll (support portion)
6 Fixed bar (rotation suppression portion)
7 Drive device
8 Driving roll
9 Nip roll
10 Fiber bundle drawing apparatus
20 Fiber bundle drawing apparatus
21 Twist prevention mechanism
51 Holder
AR0 Rotation axis of bobbin
Aa6 Arrow indicating adjustment of distance between fixed bar and free roll
Af21 Arrow indicating moving direction of twist prevention mechanism
At2 Arrow indicating component in direction parallel to rotation axis of bobbin, of traverse components of fiber bundle
G21 Gap between fixed bar and free roll
S21 Distance between fixed bar and free roll
T1 Thickness of fiber bundle
W1 Width of fiber bundle

DETAILED DESCRIPTION

In the following, to facilitate understanding, the present invention is described with reference to drawings as appropriate; however, the present invention is not limited by the drawings. Further, description about a specific example illustrated in the drawings may also be understood as description of a superordinate concept.

A. Example:

A1. Configuration and Functions of Fiber Bundle Drawing Apparatus:

FIG. 1 illustrates a fiber bundle drawing apparatus 10 according to a present example. The drawings do not accurately reflect dimensions of the fiber bundle drawing apparatus and the fiber bundle. The fiber bundle drawing apparatus 10 is an apparatus drawing a fiber bundle 1 from a bobbin 2 around which the fiber bundle 1 is traverse-wound. The fiber bundle 1 has a laterally-elongated cross-sectional shape. The term "traverse winding" means an aspect of winding in which a fiber bundle is wound while reciprocating winding positions along a center axis of a bobbin. In the traverse winding, when the fiber bundle is wound around the bobbin by one round, a position of the fiber bundle at the end of winding is shifted by a width of the fiber bundle or more from a position of the fiber bundle at the beginning of winding.

The term "width of fiber bundle" means a length of the longest line segment among line segments each connecting optional two points positioned on an outer edge of a region occupied by the fiber bundle, in a cross-section perpendicular to a longitudinal direction of the fiber bundle. The term "thickness of fiber bundle" means a length of the longest line segment among line segments each connecting two points that are positioned on the outer edge of the region occupied by the fiber bundle and positioned along a direction perpendicular to the line segment defining the width of the fiber bundle, in the cross-section perpendicular to the longitudinal direction of the fiber bundle. The width of the fiber bundle and the thickness of the fiber bundle are measured in a state where the fiber bundle is wound around the bobbin.

The fiber bundle drawing apparatus 10 includes a bobbin holder 3, a twist prevention mechanism 21, a bending-twisting roll 4, and a drive device 7 in order along a path of the fiber bundle 1 in the fiber bundle drawing apparatus 10. In the following, the fiber bundle drawing apparatus is simply referred to as "drawing apparatus" in some instances.

More specifically, the drawing apparatus 10 includes: the bobbin holder 3 to which the bobbin 2 is attached, wherein the bobbin 2 around which the fiber bundle 1 is traverse-wound; the bending-twisting roll 4 that is provided to have a center axis substantially orthogonal to a center axis direction of the bobbin 2, namely, a center axis direction of the bobbin holder 3, and removes a traverse component in the center axis direction of the bobbin holder from the fiber bundle 1 drawn from the bobbin 2; a free roll 5 that is a support portion provided between the bobbin holder 3 and the bending-twisting roll 4, namely, in a passage region of the fiber bundle 1 from the bobbin holder 3 to the bending-twisting roll 4, and supporting the fiber bundle by coming into contact with the fiber bundle 1 drawn from the bobbin 2; a fixed bar 6 that is a rotation suppression portion provided at a position facing the free roll 5 through the fiber bundle drawn from the bobbin; and the drive device 7 driving the fiber bundle.

The phrase "axis A is substantially orthogonal to axis B" means that, when the axis A is projected onto the axis B along a direction perpendicular to the axis B, an angle formed by the two axes is within a range of 90 degrees±10 degrees.

The bobbin holder 3 holds the bobbin 2 in a rotatable state (see lower part in FIG. 1). More specifically, the bobbin holder 3 is a rod-like member holding the bobbin 2 from an inside of a hole provided in the bobbin 2. The bobbin holder 3 is configured to rotate the bobbin 2 in a circumferential direction of the bobbin 2. An unillustrated torque application motor is connected to a shaft of the bobbin holder 3 holding the bobbin 2. The torque application motor is configured to generate torque in a direction opposite to rotation of the bobbin 2 and to apply constant tension to the fiber bundle 1 when the fiber bundle 1 is drawn from the bobbin 2. In FIG. 1, a rotation axis when the bobbin holder 3 rotates the bobbin 2 is indicated by AR0. The rotation axis AR0 of rotation of the bobbin 2 is coincident with the center axis of the bobbin 2.

The twist prevention mechanism 21 prevents the fiber bundle 1 from being twisted. The twist prevention mechanism 21 is provided between the bobbin holder 3 and the bending-twisting roll 4 in the path of the fiber bundle 1 in the drawing apparatus 10 (see center part in FIG. 1). The twist prevention mechanism 21 includes the free roll 5 and the fixed bar 6.

Figure 2:
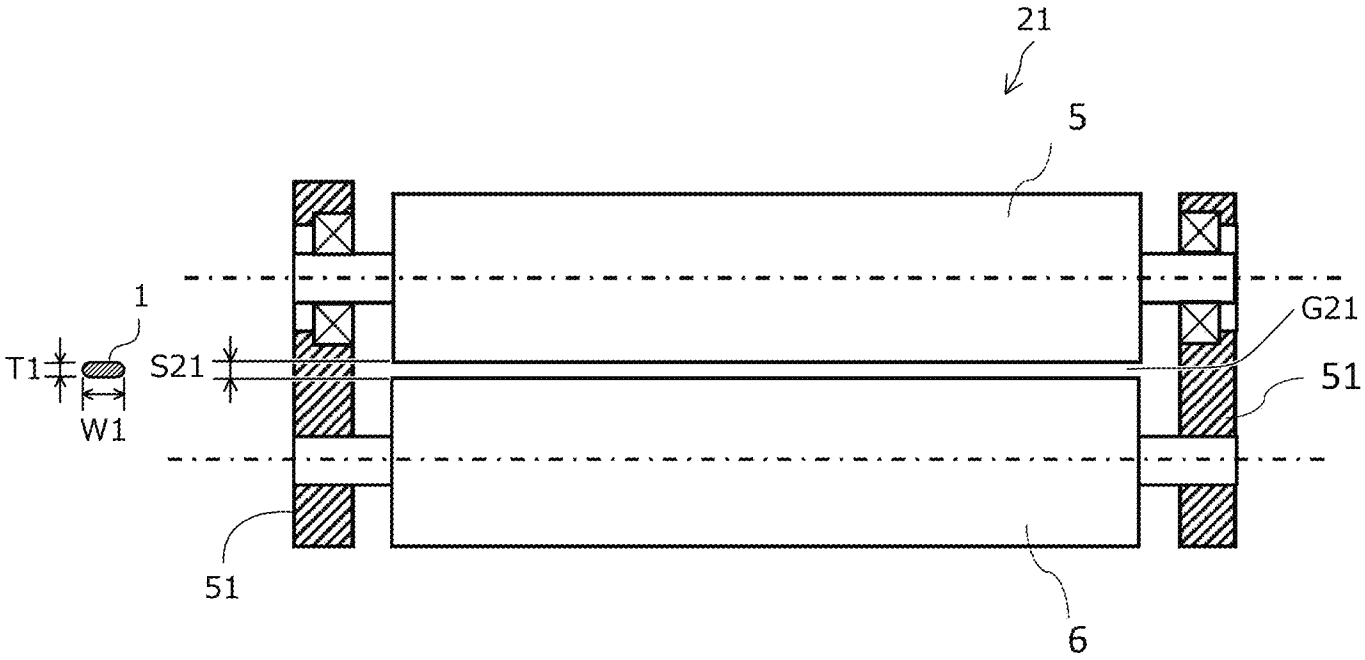
FIG. 2 is a schematic view illustrating one example of a twist prevention mechanism according to the present example.

FIG. 2 is a schematic view illustrating a configuration of the twist prevention mechanism 21. The free roll 5 comes into contact with the fiber bundle 1 drawn from the bobbin 2. More specifically, the free roll 5 is a roll configured to be rotatable around an axis substantially parallel to the center axis of the bobbin 2 (see middle right part in FIG. 1). As a result, the free roll 5 is configured to be rotatable around an axis parallel to the direction of the rotation axis AR0 of the bobbin 2. The free roll 5 is rotated with conveyance of the fiber bundle 1 in contact with the free roll 5. Such an aspect makes it possible to reduce a possibility that the fiber bundle 1 is damaged by contact with the free roll 5.

The phrase "axis A is substantially parallel to axis B" means that, when the axis A is projected onto the axis B along the direction perpendicular to the axis B, the angle formed by the two axes is 10 degrees or less.

The fixed bar 6 is disposed to face the free roll 5 with a gap G21 (see lower part in FIG. 2). More specifically, the fixed bar 6 is a columnar bar. The free roll 5 is configured to be rotatable, whereas the bar 6 is not rotatable. Therefore, the bar 6 is referred to as the fixed bar 6. The free roll 5 and the fixed bar 6 are mounted on the same holders 51. Such a configuration reduces the number of parts configuring the twist prevention mechanism 21. Further, adjustment of the gap G21 when the fiber bundle drawing apparatus 10 is installed is unnecessary.

The fixed bar 6 is installed at a position facing the free roll 5 with the fiber bundle 1 in between to be substantially parallel to a center axis of the free roll 5. In other words, the fixed bar 6 is disposed in a posture in which a longitudinal direction is parallel to the direction of the rotation axis AR0 of the bobbin 2 (see middle right part in FIG. 1). Such an aspect makes it possible to simplify the configuration of the fixed bar 6 that has a low possibility of coming into contact with the fiber bundle 1, as compared with the free roll 5.

A surface of the free roll 5 and a surface of the fixed bar 6 are separated by a distance S21 that is greater than or equal to a thickness T1 of the fiber bundle 1 and less than or equal to a width W1 of the fiber bundle 1. When the fiber bundle 1 passes through the gap G21 between the fixed bar 6 and the free roll 5, the fiber bundle 1 is prevented from being twisted. Further, the twist prevention mechanism 21 is provided at a position where the fiber bundle 1 is peeled from the surface of the bobbin 2 or at a position that is higher than that position and is lower than the bending-twisting roll 4 (see middle part in FIG. 1). The fiber bundle 1 drawn from the bobbin 2 passes through the twist prevention mechanism, and then passes through the bending-twisting roll 4.

In the twist prevention mechanism 21, the fixed bar 6 as the rotation suppression portion is adjustably disposed at the position facing the free roll 5 as the support portion through the fiber bundle 1 drawn from the bobbin 2, to be separated from the free roll 5 by a distance that is greater than or equal to the thickness T1 of the fiber bundle 1 and is less than or equal to the width W1 (see arrow Aa6 in FIG. 1). More specifically, the twist prevention mechanism 21 includes a screw for adjusting the distance S21 between the fixed bar 6 and the free roll 5. Rotating the screw in a certain direction makes it possible to increase the distance S21 between the fixed bar 6 and the free roll 5. Rotating the screw in an opposite direction makes it possible to reduce the distance S21 between the rotation suppression portion and the support portion.

Such an aspect makes it possible to draw the fiber bundle 1 having various cross-sectional shapes from the bobbin 2 while maintaining the cross-sectional shape, and to cause the fiber bundle 1 to travel along a fixed course. In FIG. 1 and FIG. 2, illustration of the screw is omitted for facilitating understanding of the technique.

The bending-twisting roll 4 is a roll rotated around a direction perpendicular to the rotation axis AR0 of the bobbin 2. The bending-twisting roll 4 is provided between the twist prevention mechanism 21 and the drive device 7 in the path of the fiber bundle 1 in the drawing apparatus 10 (see center part in FIG. 1). The bending-twisting roll 4 receives the fiber bundle 1 drawn from the bobbin 2, turns the fiber bundle 1, and delivers the bent and twisted fiber bundle 1. The path of the fiber bundle 1 is bent through the bending-twisting roll 4. As a result, change in course of the fiber bundle 1 is reduced.

The fiber bundle 1 has a laterally-elongated cross-sectional shape (see left part in FIG. 2). The fiber bundle 1 is drawn from the bobbin 2 in a posture in which the longitudinal direction of the cross-section is substantially parallel to the rotation axis AR0 of the bobbin 2, and passes through the twist prevention mechanism 21 while substantially maintaining the posture (see middle part in FIG. 1). Thereafter, the fiber bundle 1 comes into contact with the bending-twisting roll 4 as a bending-twisting mechanism, is changed in conveyance direction by substantially 90 degrees, and is then delivered from the bending-twisting roll 4. As a result, out of the traverse components of the fiber bundle 1 on the bobbin 2, a component At2 in a direction parallel to the rotation axis AR0 of the bobbin 2 is replaced with change in incident angle of the fiber bundle 1 to the bending-twisting roll 4, in a plane perpendicular to the center axis of the bending-twisting roll 4. The course of the fiber bundle 1 delivered from the bending-twisting roll 4 is fixed relative to the bending-twisting roll 4 (see middle right part in FIG. 1). When the fiber bundle 1 comes into contact with a surface of the bending-twisting roll 4, and is wound around the surface of the bending-twisting roll 4 by about 90 degrees, the longitudinal direction of the cross-section of the fiber bundle 1 is changed to the direction substantially perpendicular to the rotation axis AR0 of the bobbin 2.

The drive device 7 conveys the fiber bundle 1 (see upper right part in FIG. 1). The fiber bundle 1 is drawn from the bobbin 2 by being held and conveyed by the drive device 7. The drive device 7 is provided on a downstream side of the bending-twisting roll 4. In other words, the drive device 7 is positioned on an opposite side of the bending-twisting roll 4 from the twist prevention mechanism 21 in the path of the fiber bundle 1 in the drawing apparatus 10. The drive device 7 includes a driving roll 8 and a nip roll 9.

The driving roll 8 has a center axis substantially parallel to the center axis of the bending-twisting roll 4. The driving roll 8 is connected to an unillustrated motor adjustable in speed. A rotation speed of the driving roll 8 is settable such that the fiber bundle 1 is drawn from the bobbin 2 at a desired drawing speed and is conveyed.

The nip roll 9 has a center axis substantially parallel to the center axis of the driving roll 8. The nip roll 9 presses the fiber bundle 1 against the driving roll 8. The drive device 7 is configured to cause the fiber bundle 1 having passed through the bending-twisting roll 4 to linearly travel along the fixed course.

When the fiber bundle 1 is drawn using the drawing apparatus 10 according to the technique of the present disclosure, the following processing is performed. First, in the drive device 7, the driving roll 8 is rotated in a state where the fiber bundle 1 is nipped with the driving roll 8 and the nip roll 9. As a result, the bobbin 2 held by the bobbin holder 3 is rotated, and the fiber bundle 1 traverse-wound around the bobbin 2 is drawn from the bobbin 2. The fiber bundle 1 drawn from the bobbin 2 then reaches the twist prevention mechanism 21, and passes through the gap G21 between the free roll 5 and the fixed bar 6 while coming into contact with and being supported by the surface of the free roll 5 and being traversed along the direction of the rotation axis AR0 of the bobbin 2.

When passing through the above-described gap G21, the fiber bundle 1 comes into contact with the free roll 5, and travels along the surface of the free roll 5. As a result, irrespective of an outer diameter of the bobbin 2 around which the fiber bundle 1 is wound, a traveling position is fixed to a point where the fiber bundle 1 comes into contact with the free roll 5, in the direction of the center axis of the bending-twisting roll 4. Further, the fiber bundle 1 drawn while being traversed along the surface of the free roll 5 passes through the bending-twisting roll 4 that intersects with the center axis of the bobbin 2 at 90 degrees. As a result, the traverse component in the center axis direction of the bobbin 2 is removed, and the traveling position in the center axis direction of the bobbin 2 is fixed to a point where the fiber bundle 1 comes into contact with the bending-twisting roll 4. The term "traverse component" means change in course with the lapse of time when the fiber bundle traverse-wound around the bobbin is drawn from the bobbin. Such change in course includes change in a direction parallel to the center axis of the bobbin and change in a direction perpendicular to the center axis of the bobbin. The bending-twisting roll 4 reduces the change in course in the direction parallel to the center axis of the bobbin. Generally, the change in course of the fiber bundle drawn from the bobbin may be substantially regarded as the change in the direction parallel to the center axis of the bobbin in most instances in the relatively short run; however, in the relatively long run, the change in course of the fiber bundle drawn from the bobbin may include change in the direction perpendicular to the center axis of the bobbin due to change in winding diameter of the bobbin occurring with drawing of the fiber bundle.

Since the fixed bar 6 is provided while maintaining the certain gap G21 with the free roll 5, the following effects are achievable. Even when the fiber bundle 1 traveling following free roll 5 is loosened and nearly flutters due to change in tension caused by periodic change in distance from the bobbin 2 to the bending-twisting roll 4, the fiber bundle 1 comes into contact with the fixed bar 6, and rotation of the fiber bundle 1 is suppressed. Therefore, the fiber bundle 1 does not flutter, namely, is not rotated in the above-described gap G21. As a result, unstable twist does not occur on the fiber bundle 1 at a position between the free roll 5 and the bending-twisting roll 4, and a state of being twisted and bent by 90 degrees is stably continued. Therefore, the fiber bundle 1 may maintain the flat rectangular cross-sectional shape on the bobbin 2. In addition, meandering with twist of the fiber bundle does not occur, and the fiber bundle may stably travel in a linear shape on the downstream of the bending-twisting roll 4.

In the fiber bundle drawing apparatus 10 according to the present example, the bending-twisting roll 4 may reduce change in course of the fiber bundle 1 mainly in the direction of the rotation axis AR0 of the bobbin 2. Further, on the upstream of the bending-twisting roll 4, the free roll 5 may maintain the fixed path of the fiber bundle 1 in the direction in which the free roll 5 and the fixed bar 6 face each other. The fixed bar 6 may prevent the fiber bundle 1 from being twisted. As a result, it is possible to draw the fiber bundle that is traverse-wound around the bobbin 2 and has the laterally-elongated cross-sectional shape while maintaining the cross-sectional shape, and to cause the fiber bundle to travel along the fixed course.

The above-described change in tension is increased with increase in drawing speed of the fiber bundle 1. Therefore, with increase in drawing speed of the fiber bundle 1, a probability of occurrence of fluttering of the fiber bundle 1 causing twist is increased. However, when the fiber bundle 1 is drawn using the drawing apparatus 10 according to the present example, rotation of the fiber bundle 1 is suppressible irrespective of a speed condition. Therefore, even when the fiber bundle 1 is drawn not only under a low-speed condition that the drawing speed of the fiber bundle 1 is about 10 m/minute, but also under a high-speed condition that the drawing speed of the fiber bundle 1 is 50 m/minute or more, furthermore 100 m/minute or more, it is possible to cause the fiber bundle 1 to stably travel without generating twist. Accordingly, the technique of the present disclosure is particularly suitable for stable traveling under the high-sped condition.

The bending-twisting roll 4 according to the present example is also referred to as "bending-twisting mechanism". The free roll 5 is also referred to as "support portion". The fixed bar 6 is also referred to as "rotation suppression portion".

A2. Modifications of Fiber Bundle Drawing Apparatus:

The separation distance S21 between the free roll 5 and the fixed bar 6 is preferably less than or equal to the width of the fiber bundle 1 at which reverse rotation of the fiber bundle 1 by 90 degrees or more is suppressible in the gap G21. The separation distance between the free roll 5 and the fixed bar 6 is preferably less than or equal to 50% of the width W1 of the fiber bundle 1, and more preferably less than or equal to 25% of the width W1 of the fiber bundle 1. On the other hand, as the gap that enables the fiber bundle 1 to freely move in the center axis direction of the bobbin 2 without restraining the fiber bundle 1 on the free roll 5, the separation distance S21 between the free roll 5 and the fixed bar 6 is preferably greater than or equal to the thickness T1 of the fiber bundle 1. The width of the fiber bundle is generally 3 mm to 30 mm, and the thickness is generally 10 μm to 2 mm. Therefore, the separation distance S21 between the free roll 5 and the fixed bar 6 is preferably set to 10 μm to 30 mm.

The angle formed by the center axis of the bending-twisting roll 4 and the center axis of the bobbin 2 is not required to be 90 degrees. However, to fix the traveling position of the fiber bundle 1 and to prevent meandering, the angle formed by the center axis of the bending-twisting roll 4 and the center axis of the bobbin 2 is preferably an angle close to 90 degrees.

Each of the free roll 5 and the fixed bar 6 is preferably made of a metal, preferably has a surface subjected to hard chromium plating treatment or ceramic treatment, and preferably has a mat surface with a surface roughness (arithmetic average roughness described in JIS B 0601:1994) Ra of 0.8 to 1.6.

Figure 3A:
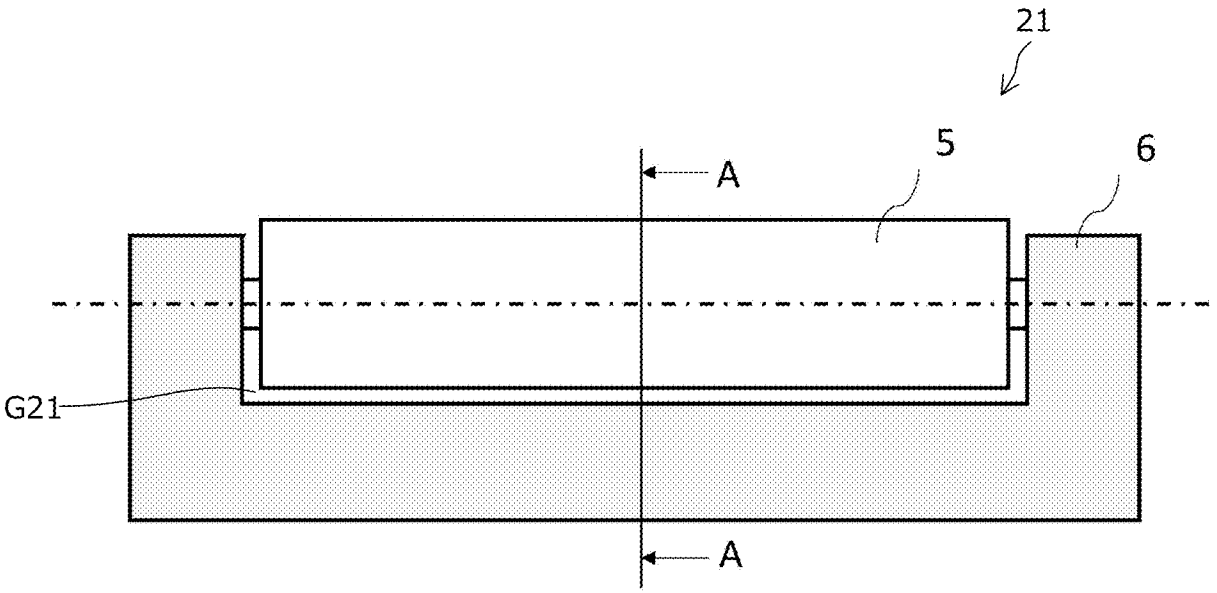
FIG. 3A is a plan view illustrating another example of the twist prevention mechanism.
Figure 3B:
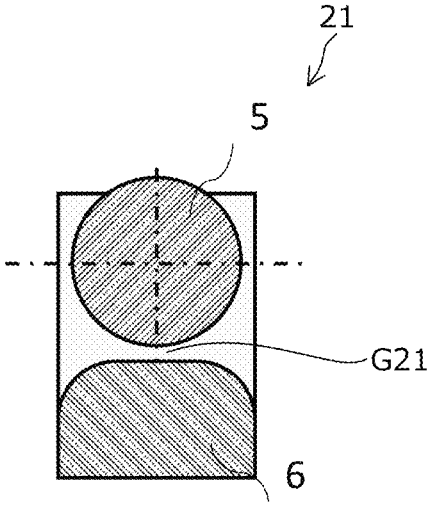
FIG. 3B is a cross-sectional view of the twist prevention mechanism in FIG. 3A taken along line A-A.

FIG. 3A is a plan view illustrating another example of the twist prevention mechanism. FIG. 3B is a cross-sectional view of the twist prevention mechanism in FIG. 3A taken along line A-A. In the present example, as illustrated in FIG. 3A, the rotation suppression portion 6 is greater in width than the free roll 5 as the support portion. In other words, in the direction of the rotation axis of the free roll 5, a dimension of the rotation suppression portion 6 is greater than a dimension of the free roll 5. The rotation suppression portion 6 is a member including ends extending to respective sides of the free roll 5. Each end of the free roll 5 is supported by the respective ends of the rotation suppression portion 6 extending to both sides of the free roll 5. In other words, the rotation suppression portion 6 also functions as a holder supporting the free roll 5. The twist prevention mechanism 21 may have a configuration in which, for example, holes or bearing holders are provided at both ends of the rotation suppression portion 6 and the free roll 5 is attached thereto. As illustrated in the cross-sectional view in FIG. 3B, a ridge line part of the rotation suppression portion 6 coming into contact with the fiber bundle 1, namely, a corner part facing the free roll 5 is preferably chamfered and rounded to suppress abrasion with the fiber bundle 1.

Figure 4A:
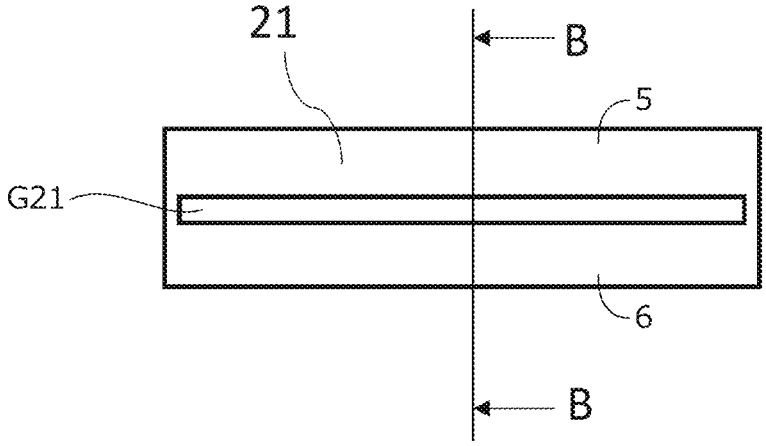
FIG. 4A is a plan view illustrating still another example of the twist prevention mechanism.
Figure 4B:
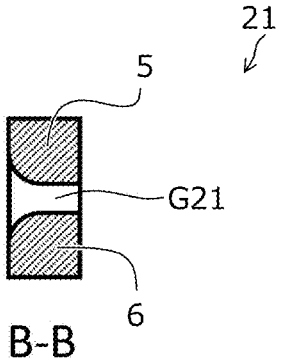
FIG. 4B is a cross-sectional view of the twist prevention mechanism in FIG. 4A taken along line B-B.

FIG. 4A is a plan view illustrating still another example of the twist prevention mechanism. FIG. 4B is a cross-sectional view of the twist prevention mechanism in FIG. 4A taken along line B-B. In the present example, as illustrated in FIG. 4A, the twist prevention mechanism 21 is an integrated member installed to surround the fiber bundle 1 passing through the twist prevention mechanism 21. In other words, the support portion and the rotation suppression portion respectively correspond to one portion 5 and the other portion 6 of the same member. In the present example, to suppress abrasion with the fiber bundle 1, a ridge line part of the twist prevention mechanism 21 facing the fiber bundle 1 is preferably chamfered and rounded as with the cross-sectional shape illustrated in FIG. 4B.

Figure 5:
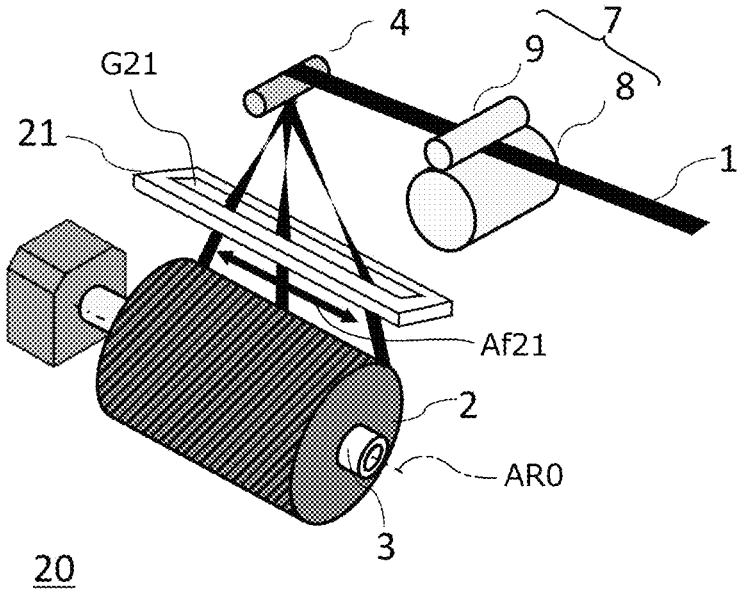
FIG. 5 is a schematic view of a fiber bundle drawing apparatus including the twist prevention mechanism illustrated in FIG. 4A and FIG. 4B.

FIG. 5 illustrates a drawing apparatus 20 including the twist prevention mechanism according to the example illustrated in FIG. 4A and FIG. 4B. As illustrated, in the drawing apparatus 20 according to the present example, the structure of the twist prevention mechanism is simplified. Therefore, the number of members configuring the twist prevention mechanism is reduced. Further, adjustment of the gap G21 when the drawing apparatus 20 is installed is unnecessary.

In the drawing apparatus 20, the twist prevention mechanism 21 is configured to reciprocate in a direction parallel to the axis direction of the bobbin holder 3, namely, in a direction parallel to the direction of the rotation axis AR0 of the bobbin 2. As a result, the twist prevention mechanism 21 may follow the fiber bundle 1 traversed in the axis direction of the bobbin holder 3. More specifically, the twist prevention mechanism 21 is configured to move in a direction parallel to the axis direction of the bobbin holder, and is configured to reciprocate with the fiber bundle 1, in the direction parallel to the axis direction of the bobbin holder by coming into contact with the fiber bundle 1. In such a configuration, the twist prevention mechanism 21 moves in the direction parallel to the direction of the rotation axis AR0 of the bobbin 2 by following change in course of the fiber bundle 1 drawn from the bobbin 2. In FIG. 5, a moving direction of the twist prevention mechanism 21 is indicated by an arrow Af21.

A swing width of the fiber bundle 1 drawn from the bobbin 2 is varied depending on a width of the bobbin 2. Therefore, in the drawing apparatus in which the twist prevention mechanism 21 is fixed, it is necessary to prepare a plurality of twist prevention mechanisms 21 having various widths, and to exchange the plurality of twist prevention mechanisms 21 based on the width of the bobbin 2 attached to the drawing apparatus. In the above-described aspect, however, a movable distance of the twist prevention mechanism is sufficiently largely provided, which makes it possible to achieve the following effects without preparing the plurality of twist prevention mechanisms 21 corresponding to various widths of the bobbin 2. In other words, it is possible to attach the bobbin 2 having various widths to the fiber bundle drawing apparatus 10, and to draw the fiber bundle 1 traverse-wound around the bobbin 2 while maintaining the cross-sectional shape and to cause the fiber bundle 1 to travel along the fixed course.

On the other hand, the twist prevention mechanism 21 may include a driving mechanism moving the twist prevention mechanism 21 in the direction parallel to the axis direction of the bobbin holder 3, a video camera, and a control unit. In such an aspect, the control unit may control the driving mechanism based on a position of the fiber bundle 1 imaged by the video camera, and move the twist prevention mechanism 21 in the direction parallel to the axis direction of the bobbin holder 3.

The drive device 7 is not limited to the above-described configuration, and may not include the nip roll 9, and may wrap the fiber bundle 1 around one or a plurality of driving rolls 8 at a fixed wrap angle. Further, the drive device 7 may be not provided, and the fiber bundle 1 may be directly received by a winding apparatus and directly wound around the bobbin 2.

Figure 6:
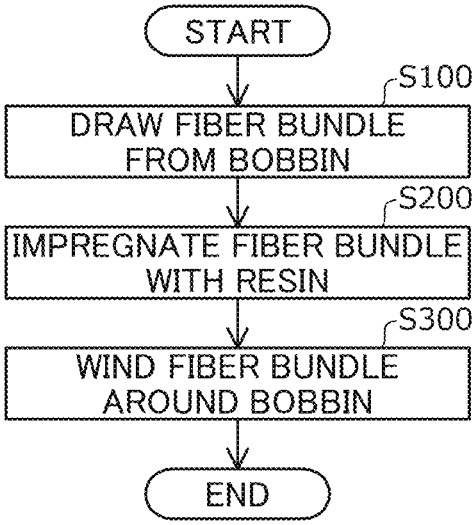
FIG. 6 is a flowchart illustrating a method of manufacturing a fiber composite material.

A3. Method of Manufacturing Fiber Composite Material:

FIG. 6 is a flowchart illustrating a method of manufacturing a fiber composite material. The fiber composite material is manufactured through steps in the flowchart illustrated in FIG. 6. The manufactured fiber composite material contains the fiber bundle and a resin impregnated into the fiber bundle. In the present example, the resin impregnated into the fiber bundle is a thermosetting resin. As fiber configuring the fiber bundle, carbon fiber, aramid fiber, glass fiber, silicon carbide fiber, alumina fiber, or the like is adoptable.

In step S100, the fiber bundle 1 is continuously drawn from the bobbin 2 around which the fiber bundle 1 is traverse-wound. In the processing in step S100, the fiber bundle drawing apparatus 10 according to the present disclosure is used (see FIG. 1 and FIG. 2). Performing such processing makes it possible to draw the fiber bundle 1 traverse-wound around the bobbin 2 and having the laterally-elongated cross-sectional shape while maintaining the cross-sectional shape, and to cause the fiber bundle 1 to travel along the fixed course.

In step S100, the distance S21 between the fixed bar 6 and the free roll 5 is set to 50% or less of the width W1 of the fiber bundle 1, for example, 5% of the width W1 of the fiber bundle 1 (see FIG. 2). When the distance S21 between the fixed bar 6 and the free roll 5 is set to 50% or less of the width W1 of the fiber bundle 1, the fixed bar 6 may effectively prevent the fiber bundle 1 from being twisted.

In step S200, the fiber bundle 1 is impregnated with the resin. More specifically, the fiber bundle 1 drawn from the bobbin 2 is caused to pass through a tank housing uncured thermosetting resin. As a result, the fiber bundle 1 is impregnated with the resin, and the fiber composite material is completed. Performing the processing in steps S100 and S200 makes it possible to manufacture the fiber composite material having a cross-sectional shape with a designed width and a designed thickness.

In step S300, the fiber bundle 1 impregnated with the resin is wound around a bobbin different from the bobbin 2 around which the fiber bundle 1 is traverse-wound in step S100.

As easily understood by those skilled in the art, the present invention is not limited to the examples. For example, it should be understood that, for example, appropriate change and application of combinations of the members, the configurations, and the like described in each of the examples, and appropriate replacement and application of the members, the configurations, and the like described in each of the examples with a well-known technique or members, configurations, and the like easily conceivable by those skilled in the art from a well-known technique are included.

EXAMPLES

Example 1

Examples of the present disclosure are described in detail with reference to drawings. As the fiber bundle drawing apparatus, the apparatus 10 having the configuration illustrated in FIG. 1 was used. As the fiber bundle 1, a carbon fiber bundle having the number of single filaments of 36000, the width W1 of 10 mm, the thickness T1 of 120 μm, tensile strength of 5800 MPa, and an elastic modulus of 295 GPa was used. As each of the support portion 5 and the rotation prevention portion 6 configuring the twist prevention mechanism 21, a free roll that had a diameter of 50 mm and in which a surface roughness Ra of a mat surface subjected to hard chromium plating treatment was 1.6 was used. The distance S21 of the gap G21 between the support portion 5 and the rotation suppression portion 6 was set to 300 μm. In other words, in Example 1, the distance S21 of the gap G21 was 3% of the width W1 of the fiber bundle 1 and was 250% of the thickness T1 of the fiber bundle 1. As the bending-twisting roll 4, a free roll that had a diameter of 20 mm and in which a surface roughness Ra of a mat surface subjected to hard chromium plating treatment was 1.6 was prepared. The bending-twisting roll 4 was installed in a direction orthogonal to the center axis of the bobbin 2 at 90 degrees.

A camera was installed above the bending-twisting roll 4, and the shape of the fiber bundle 1 on the bending-twisting roll 4 was imaged. A state where the width W1 of the fiber bundle was contracted to 10% or less of the original width of the fiber bundle was defined as twist, and the number of times of occurrence of twist was measured. As a result of drawing the fiber bundle 1 by 300 m at 10 m/minute by using the drawing apparatus 10, the number of times of occurrence of twist was zero.

Example 2

The fiber bundle 1 was drawn from the bobbin under the same condition as Example 1 except that the drawing speed of the fiber bundle 1 was set to 300 m at 50 m/minute. As a result, the number of times of occurrence of twist was zero.

Example 3

The fiber bundle 1 was drawn from the bobbin under the same condition as Example 1 except that the drawing speed of the fiber bundle 1 was set to 300 m at 100 m/minute. As a result, the number of times of occurrence of twist was zero.

Comparative Example 1

The two free rolls 5 and 6 configuring the twist prevention mechanism 21 were detached from the fiber bundle drawing apparatus 10 used in Example 1, and the fiber bundle 1 was drawn by using the resultant fiber bundle drawing apparatus. The other conditions were the same as in Example 1. As a result, twist occurred five times.

Comparative Example 2

The fiber bundle 1 was drawn by 300 m at 50 m/minute. The other conditions are same as in Comparative Example 1. As a result, twist occurred 44 times.

Comparative Example 3

The fiber bundle 1 was drawn by 300 m at 100 m/minute. The other conditions are same as in Comparative Example 1. As a result, twist occurred 72 times.

Comparative Example 4

In the fiber bundle drawing apparatus 10 used in Example 1, the distance S21 of the gap G21 between the free roll 5 and the fixed bar 6 was set to 100 μm. In other words, in Comparative Example 4, the distance S21 of the gap G21 was less than the thickness T1 of the fiber bundle 1. The fiber bundle 1 was drawn from the fiber bundle drawing apparatus 10 set in such a manner, by 300 mm at 50 m/minute. The other conditions were the same as in Example 1. As a result, twist occurred 80 times.

Comparative Example 5

In the fiber bundle drawing apparatus 10 used in Example 1, the distance S21 of the gap G21 between the free roll 5 and the fixed bar 6 was set to 11 mm. In other words, in Comparative Example 5, the distance S21 of the gap G21 was greater than the width W1 of the fiber bundle 1. The fiber bundle 1 was drawn from the fiber bundle drawing apparatus 10 set in such a manner, by 300 m at 50 m/minute. As a result, twist occurred 42 times.

It was confirmed from the above-described examples that, even when the fiber bundle is drawn from the bobbin at high speed, using the technique according to the present disclosure makes it possible to draw the fiber bundle while maintaining a stable rectangular cross-sectional shape without generating twist. The apparatus according to the present disclosure is particularly useful for drawing a fiber bundle of reinforced fiber used for a fiber composite material, such as carbon fiber, aramid fiber, glass fiber, silicon carbide fiber, and alumina fiber, in particular, for drawing a carbon fiber bundle.

B. Other Examples

B1. Other Example 1:

In the above-described example, the rotation suppression portion is the rod-like fixed bar 6 (see center part in FIG. 1). However, as illustrated in FIGS. 3A and 3B, the rotation suppression portion may include a portion other than a rod-like portion.

In the above-described example, the twist prevention mechanism 21 is configured such that the distance between the rotation suppression portion and the support portion is adjustable by the screw. However, the twist prevention mechanism may be configured such that the distance between the rotation suppression portion and the support portion is adjustable by, for example, adjusting the number of spacers provided between the rotation suppression portion and the support portion.

In the above-described example, the bending-twisting mechanism is the bending-twisting roll 4. However, the bending-twisting mechanism is not particularly limited as long as the mechanism may reduce the traverse component of the fiber bundle, and may be a nonrotatable bar or a ring-like member. For example, the bending-twisting mechanism includes a yarn contact portion coming into contact with the fiber bundle, and the yarn contact portion may be a curved surface forming at least a part of a cylindrical shape including an axis in a direction different from the rotation axis of the bobbin. The fiber bundle drawn from the bobbin comes into contact with the bending-twisting mechanism along a yarn contact surface. As a result, the fiber bundle is bent and twisted between the bobbin and the bending-twisting mechanism, and the bent and twisted fiber bundle is delivered to the downstream. A direction of an axis of the yarn contact surface is preferably substantially orthogonal to the direction of the rotation axis of the bobbin. Further, the bending-twisting mechanism does not come into contact with the fiber bundle from one side, but comes into contact with the fiber bundle from the other side, which makes it possible to turn the fiber bundle and to deliver the fiber bundle. Such an aspect makes it possible to reduce risks of disconnection of the fiber bundle and a failure of the fiber bundle drawing apparatus due to catching of the fiber bundle by the bending-twisting mechanism.

In the above-described example, the bending-twisting roll 4 is described as a mechanism removing the traverse component from the fiber bundle 1 (see upper left part in FIG. 1). However, the bending-twisting mechanism may not completely remove the traverse component at the time of drawing the fiber bundle from the bobbin. In other words, it is sufficient for the bending-twisting mechanism to reduce change in course of the fiber bundle in the direction of the rotation axis of the bobbin.

Further, the bending-twisting mechanism may include a plurality of bending-twisting members each including a curved surface having a fixed shape in a direction different from the direction of the rotation axis of the bobbin. At this time, the curved surfaces of the bending-twisting members are directed to directions different from one another, and gradually change a twisting and bending angle of the fiber bundle.

Further, to suppress change in course of the fiber bundle in the direction of the rotation axis of the bobbin in the steps on the upstream and to reduce influence on the steps on the downstream, the bending-twisting mechanism is preferably installed on the upstream close to the bobbin holder. In a passage region of the fiber bundle, a minimum device is preferably installed between the bobbin holder and the bending-twisting mechanism.

Further, to prevent sudden bending and twisting of the fiber bundle from causing the fiber bundle to become twisted along its longitudinal direction when the fiber bundle passes through the bending-twisting mechanism, a distance greater than or equal to 30 times the width of the fiber bundle is preferably secured between the bending-twisting mechanism and a device installed on the upstream side of the bending-twisting mechanism in a passage direction of the fiber bundle.

B2. Other Example 2:

In the above-described example, the twist prevention mechanism 21 includes the screw for adjusting the distance S21 between the fixed bar 6 as the rotation suppression portion and the free roll 5 as the support portion (see middle left part in FIG. 2). However, the twist prevention mechanism may not include a function of adjusting the distance between the rotation suppression portion and the support portion (see FIG. 4A and FIG. 4B). For example, the separation distance between the support portion and the rotation suppression portion may be fixed as long as the apparatus operates based on the premise that the width and the thickness of the fiber bundle are fixed.

B3. Other Example 3:

In the above-described example, the twist prevention mechanism 21 includes, as the support portion, the free roll 5 that is configured to be rotatable around the axis substantially parallel to the center axis of the bobbin 2 (see upper part in FIG. 2). However, the twist prevention mechanism may include, as the support portion, a nonrotatable member, for example, a fixed bar disposed in a posture in which a longitudinal direction is parallel to the direction of the rotation axis AR0. In other words, it is sufficient that the support portion is configured to come into contact with the fiber bundle.

B4. Other Example 4:

In the above-described example, the twist prevention mechanism 21 includes, as the rotation suppression portion, the fixed bar 6 disposed in a posture in which the longitudinal direction is parallel to the direction of the rotation axis AR0 (see lower part in FIG. 2). However, the twist prevention mechanism may include, as the rotation suppression portion, a free roll configured to be rotatable around an axis substantially parallel to the center axis of the bobbin. In other words, one or both of the support portion and the rotation suppression portion may be configured as rotatable rolls, or one or both of the support portion and the rotation suppression portion may be configured as nonrotatable members.

However, the twist prevention mechanism is preferably configured not to come into contact with the fiber bundle from one side and to come into contact with the fiber bundle from the other side, in a state where the fiber bundle is not rotated as viewed from the conveyance direction. Such an aspect makes it possible to reduce risks of disconnection of the fiber bundle and a failure of the fiber bundle drawing apparatus due to catching of the fiber bundle by the twist prevention mechanism.

B5. Other Example 5:

In the example described above, the twist prevention mechanism 21 moves in the direction parallel to the direction of the rotation axis AR0 of the bobbin 2 by following change in course of the fiber bundle 1 drawn from the bobbin 2 (see Af21 in FIG. 5). However, the twist prevention mechanism may be configured not to move in the direction of the rotation axis of the bobbin.

B6. Other Example 6:

In step S100 in the method of manufacturing the fiber composite material illustrated in FIG. 6, when the fiber bundle 1 is continuously drawn from the bobbin 2 around which the fiber bundle 1 is traverse-wound is described for facilitating understanding of the technique. However, the drawing of the fiber bundle may be stopped one or more times until all of the traverse-wound fiber bundle is drawn from the bobbin.

B7. Other Example 7:

In step S100 in the method of manufacturing the fiber composite material illustrated in FIG. 6, the distance S21 between the fixed bar 6 as the rotation suppression portion and the free roll 5 as the support portion is set to 5% of the width W1 of the fiber bundle 1 (see Aa6 in FIG. 2). However, the distance between the rotation suppression portion and the support portion may be set to the other value such as 2%, 3%, 5%, 10%, 20%, 30%, 50%, and 80% of the width of the fiber bundle. However, the distance between the rotation suppression portion and the support portion is preferably set to 2% to 20% of the width of the fiber bundle, more preferably set to 2% to 10% of the width of the fiber bundle, and further preferably set to 2% to 5% of the width of the fiber bundle.

B8. Other Example 8:

In the method of manufacturing the fiber composite material illustrated in FIG. 6, in step S100, the fiber bundle drawing apparatus 10 is used (see FIG. 1 and FIG. 2). However, when the fiber bundle is drawn from the bobbin around which the fiber bundle is traverse-wound, an optional apparatus and an optional drawing method according to the present disclosure, such as the fiber bundle drawing apparatus 20 may be used (see FIG. 3 to FIG. 5).

The present disclosure is not limited to the above-described example, and may be realized with various configurations without departing from the gist of the present disclosure. For example, the technical features of the example corresponding to the technical features in the aspects described in Summary may be appropriately replaced or combined to solve a part or all of the above-described issues or to achieve a part or all of the above-described effects. The technical features that are not described as essential are appropriately deletable.

What is claimed is:

1. A fiber bundle drawing apparatus drawing a fiber bundle from a bobbin around which the fiber bundle is traverse-wound, the fiber bundle drawing apparatus comprising:

a bobbin holder configured to hold the bobbin in a rotatable state;

a bending-twisting mechanism configured to receive the fiber bundle drawn from the bobbin, and to bend, twist, and deliver the fiber bundle, thereby reducing change in course of the fiber bundle in a direction parallel to a center axis of the bobbin; and a twist prevention mechanism provided between the bobbin holder and the bending-twisting mechanism in a path of the fiber bundle in the apparatus, and including a support portion and a rotation suppression portion, the support portion coming into contact with the fiber bundle, the rotation suppression portion being disposed to face the support portion with a gap through which the fiber bundle passes, the gap having a distance greater than or equal to a thickness of the fiber bundle and less than or equal to a width of the fiber bundle;

wherein the support portion is a roll configured to be rotatable around an axis parallel to a direction of a rotation axis of the bobbin.

2. The fiber bundle drawing apparatus according to claim 1, wherein the twist prevention mechanism is configured to adjust the distance.

3. The fiber bundle drawing apparatus according to claim 1, wherein the rotation suppression portion includes a bar disposed in a posture in which a longitudinal direction of the bar is parallel to a direction of a rotation axis of the bobbin.

4. The fiber bundle drawing apparatus according to claim 1, wherein the twist prevention mechanism is configured to move in a direction parallel to a direction of a rotation axis of the bobbin by following change in course of the fiber bundle drawn from the bobbin.

5. A method of drawing a fiber bundle from a bobbin around which the fiber bundle is traverse-wound, the method comprising continuously drawing the fiber bundle from the bobbin by using the apparatus according to claim 1.

6. The method of drawing the fiber bundle according to claim 5, wherein the distance is set to less than or equal to 50% of a width of the fiber bundle.

7. A method of manufacturing a fiber composite material containing a fiber bundle and a resin impregnated into the fiber bundle, the method comprising drawing the fiber bundle from a bobbin around which the fiber bundle is traverse-wound, by using the method of drawing the fiber bundle according to claim 5.

* * * * *